US005235305A

United States Patent [19]

Scheffler

[11] Patent Number: 5,235,305

[45] Date of Patent: Aug. 10, 1993

[54] TERMINALS FOR COIL BODY OF ELECTRICAL COILS

[75] Inventor: Horst Scheffler, Munich, Fed. Rep. of Germany

[73] Assignee: Siemens Aktiengesellschaft, Munich, Fed. Rep. of Germany

[21] Appl. No.: 495,166

[22] Filed: Mar. 19, 1990

[30] Foreign Application Priority Data

Apr. 25, 1989 [DE] Fed. Rep. of Germany ... 8905229[U]

[51] Int. Cl.[5] ..... H01F 15/10

[52] U.S. Cl. ..... 336/192; 29/602.1; 336/208; 439/74

[58] Field of Search ..... 336/192, 198, 208; 439/74, 76, 78; 310/71; 29/602.1

[56] References Cited

U.S. PATENT DOCUMENTS

| | | | |
|---|---|---|---|
| 4,010,435 | 3/1977 | Shigehara | 336/192 |
| 4,092,622 | 5/1978 | Widemann et al. | 336/192 |
| 4,135,297 | 1/1979 | Guttlenberger et al. | 336/192 |

FOREIGN PATENT DOCUMENTS

| | | | |
|---|---|---|---|
| 2320820 | 11/1974 | Fed. Rep. of Germany | 336/192 |
| 58532 | 10/1967 | German Democratic Rep. | 336/192 |
| 63-29916 | 2/1988 | Japan | 336/192 |
| 611347 | 10/1948 | United Kingdom | 336/192 |
| 2229427 | 1/1974 | United Kingdom | 336/192 |

OTHER PUBLICATIONS

*Siemens Datenbuch*, entitled "Ferrite", p. 441, (1986/87).

*Primary Examiner*—Thomas J. Kozma
*Attorney, Agent, or Firm*—Hill, Steadman & Simpson

[57] ABSTRACT

A coil body for electrical coils includes a solder terminal strip applied to the coil body flange which has solder eye terminals arranged in a row. One end of the solder eye terminals are in the form of solder eyes for wrapping and winding wire ends of thin wires or for holding the ends of thick wires, and the other end of the solder eye terminals are pins for emplacement into printed circuit boards. The solder eye terminals are in the form of right-angle wires injected into the solder terminal strips, whose one ends are bent U-shaped and are spaced from the solder terminal strips a sufficient distance to enable automatic winding onto the bent U-shaped end.

6 Claims, 3 Drawing Sheets

TERMINALS FOR COIL BODY OF ELECTRICAL COILS

BACKGROUND OF THE INVENTION

1. Field of the Invention

The present invention is directed generally to a coil member for electrical coils, and more particularly to solder terminal strips applied to the flange of a coil member and having solder eye terminal arranged in a row, the solder eye terminals having one end in the form of solder eyes for wrapping and winding wire ends and the other end in the form of pins for emplacement on or in printed circuit boards.

2. Description of the Related Art

In electrical coils that are composed of, for example, a wound coil member and ferrite E-shaped core halves that have their center arm extending into the coil member and wherein greater electrical currents mainly flow in the secondary circuit, thicker wires, such as those having a diameter of at least 0.45 mm, and stranded conductors are generally required because of the higher current loads being carried by the wires. There is a risk when winding such thick winding wires to straight terminal pins, such as using wire wrap techniques, that the wire ends, which are usually referred to as winding locks, will become undone. During subsequent soldering of the wound wire ends to the terminal pins and also possibly to the corresponding interconnects of the printed circuit boards as well, that is a possibility that what are referred to as "cold solder locations" and contact bridges to neighboring terminal pins can arise as a result thereof. It is therefore necessary that the winding ends of the wires be clearly defined in their position relative to the coil body terminal and relative to the terminal pin. In other words, the wound ends of the wire should be either positively or non-positively locked into a defined position. Moreover, thinner winding wires, such as, for example, wires having a stranding winding thickness, should be capable of being automatically wound onto the terminal pins with automatic winding machines.

A known EC coil body 1 is shown in FIGS. 1 and 1*a* having right angled solder eye terminals 7 for fixing thick wires and stranded conductors. Extremely thin wires can also be wound to such solder eye terminals; however, to wind such thin wires, a relative pivot motion between the coil body and a wire guide of the automatic winding machine of about 90° is necessary first as the coil is wound in a coil winding position and second as the solder terminal is wrapped in a terminal wrapping position. The winding process, which is already time consuming, is thereby lengthened even more.

Solder eye terminals 7 for the known EC coil bodies are punched parts which are tin-plated and subsequently introduced into slot-shaped recesses 7 of the injection molded coil members. The fabrication steps of punching, tin-plating, and mounting the solder eye terminals requires a considerable outlay and thus makes the coil body even more expensive.

SUMMARY OF THE INVENTION

An object of the present invention is to provide a coil body for electrical coils of the type described initially which can be manufactured with little cost and which is also suitable for automatic winding of even extremely thin wires, for example, of stranding thickness.

To achieve this and other objects, the invention provides a coil body for electrical coils having solder terminal strips applied to the coil body flanges and having solder eye terminals arranged in a row, whose one ends are solder eyes for wrapping and winding wire ends and whose other ends are pins for emplacement on printed circuit boards. The solder eye terminals are right-angled wire pins inserted into the solder terminal strips, the right angled wire pins having one end bent U-shaped to form the solder eyes. The spacing between the solder terminal strips and end faces of the curved U-shaped ends of the right-angled wire pins is selected of at least such size that wires, and preferable round wires or square wires, can be automatically wound to these ends even when multi-stranded wires having a greater thickness are used.

Due to the use of wire pins as solder eye terminals, the wire from which the wire pins is formed can be continuously removed from a wire roll and can be directly injected into the solder terminal strips of the coil member during injection of the coil member. It is also possible to simultaneously and automatically bend on end of the wire pins into a U-shaped curvature to form the solder eyes.

Given use of stranded conductors and thick wires as coil winding wires, such conductors and wires are drawn through the wire guide slot that may be partially formed in the coil member flange and partially in the solder terminal strips and through that end of the solder terminal which is curved into a U-shape, whereby the stranded conductors or wires clamp between the solder terminal strip and the solder terminal. The winding ends of the wires or conductors are thereby additionally secured against slippage.

When the spacing between the solder terminal strip in which the solder eye terminal is embedded and the end faces of its curved U-shaped ends is selected at least of such size that the wire guide tube of an automatic winding unit can "tumble through" the interspace created in this way, thinner wires can also be automatically wound to the solder eye terminal without a pivot motion of the wire guide tube having to be carried after wrapping of the wire carrier of the coil body for the purpose of winding the winding wire end to the solder eye. In other words, the automatic winding device first winds the coil body to from the coil with the wire guide tube oriented in one direction. The present invention enables this same automatic winding device to wind this wire, if thin, on the solder eye terminal without reorienting the wire guide tube.

BRIEF DESCRIPTION OF THE DRAWINGS

The invention will be set forth in greater detail below with reference to exemplary embodiments which are shown in the drawings.

DESCRIPTION OF THE PREFERRED EMBODIMENTS

Figure 1:
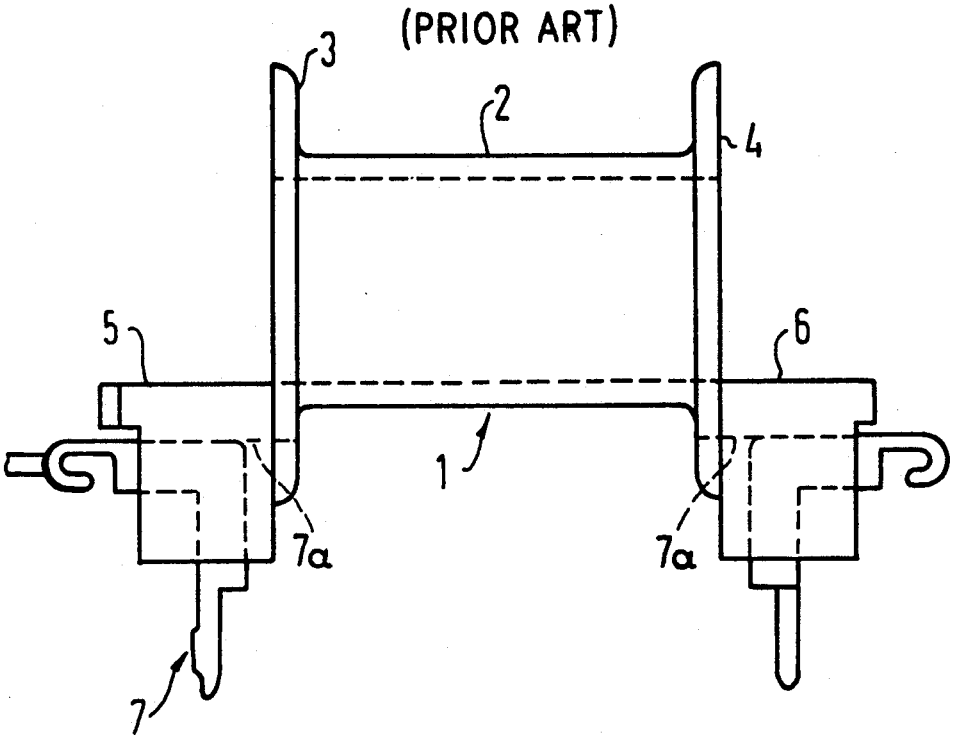
FIG 1 (PRIOR ART)
FIG. 1 is a side elevational view of a known EC coil body.
Figure 1A:
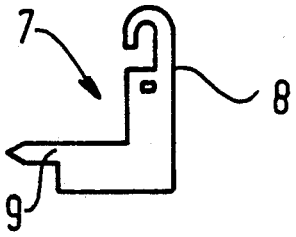
FIG 1a (PRIOR ART)
FIG. 1*a* is a plan view of a known solder eye terminal from the coil body of FIG. 1.

The coil body 1 shown in FIGS. 1 and 1*a*, which has already been described, includes a coil member 2 with coil body flanges 3 and 4 and solder terminal strips 5 and 6. In FIG. 1, the solder terminal strips 5 and 6 have right-angle recesses, or channels, 7*a* indicated with broken lines into which known solder eye terminals 7 are introduced. The known solder eye terminal 7 is shown in FIG. 1*a* and is formed by being punched from sheet metal. One end of each solder eye terminal 7 has a solder eye 8 and the other end carries a pin-shaped end 9 for emplacement in printed circuit boards.

Figure 2:
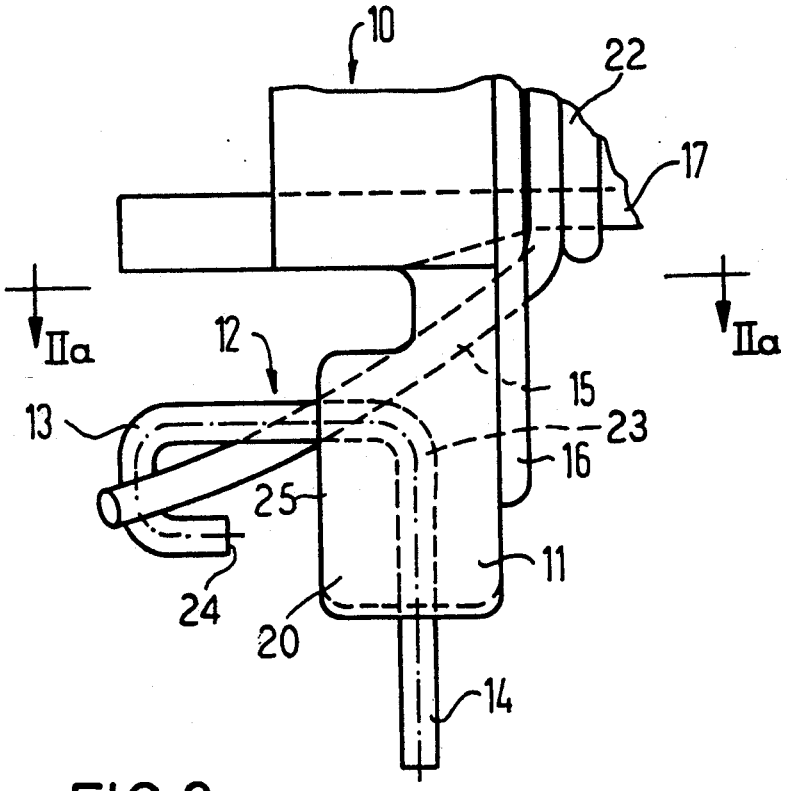
FIG. 2 is an enlarged fragmentary view of an exemplary embodiment of a coil body of the present invention wherein a winding wire end is shown approaching a solder eye terminal partially in phantom.
Figure 2A:
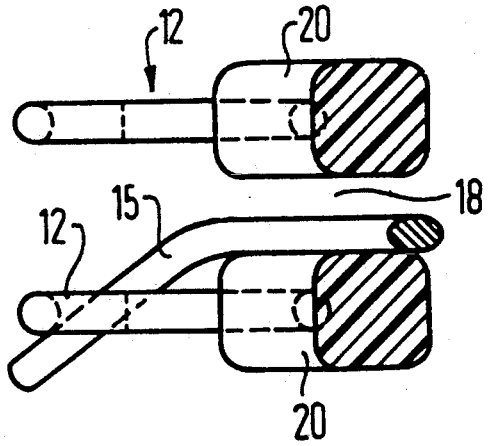
FIG. 2*a* is a cross section along line IIa—IIa showing two solder eye terminals embedded in a solder terminal strip of the coil body in FIG. 2, together with a winding wire end brought to one of the two solder eye terminals.
Figure 3:
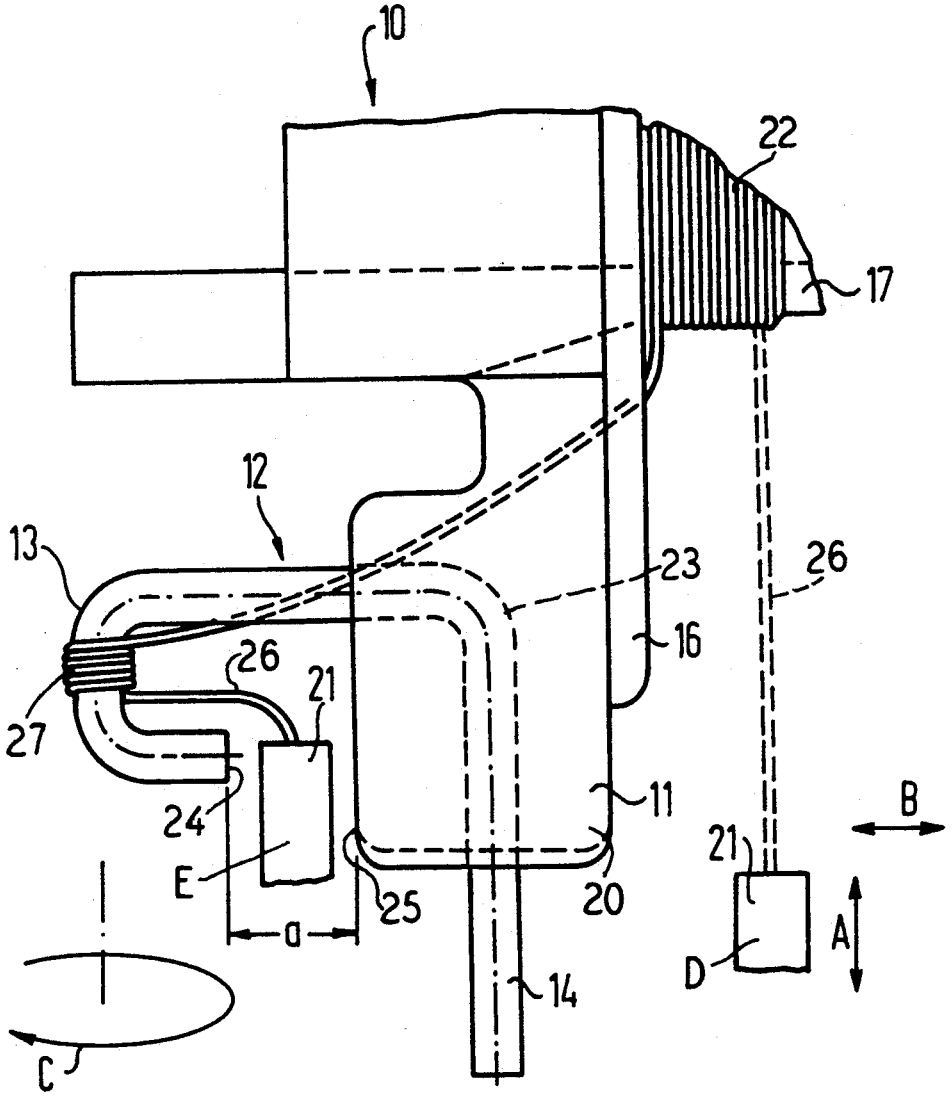
FIG. 3 is an enlarged fragmentary view of the coil member of FIG. 2 showing a winding position for wrapping and winding of a thin wire using a wire guide tube of an automatic winding unit.

Referring to FIGS. 2, 2*a* and 3, a coil body 10 of the present invention is shown in part, the coil body containing many of the same general features of the known coil body of FIG. 1. The illustrated coil body 10 has a winding carrier 17 similar to the coil member 2 of FIG. 1 for carrying a wound coil 22, a coil body flange 16 similar to the flange 3 of FIG. 1, and solder terminal strips 11 applied integrally to the coil body flange 16. Of course, a flange and terminal strip may be provided at the other end of the coil body 10 as well. The solder terminal strips 11 include at least one wire lead-out slot 18, shown in FIG. 1*a*, as well as elements 20 and 20' into which solder terminals 12 and 12' shaped like wire pins are injected. The solder terminals 12 and 12', which are preferably shaped from wires, are formed with right angle bends 23 and each include a bent U-shaped region 13 at one end. The other end of each solder terminal 12 and 12' is formed as a pin 14. The pin portions 14 enable the coil body 10 to be mounted on a printed circuit board, such as by inserting the pins 14 into openings in the circuit board.

In the exemplary embodiment of FIG. 2, a winding wire end 15 of a thick winding wire is drawn through the wire lead-out slot 18 of the coil member 10 and through the U-shaped end 13 of the solder eye terminal 12. As shown in FIG. 2*a*, the wire end 15 is held against the wall of the element 20 of the solder terminal strip 11 away from other solder terminals 12'. The wire end 15 is also held tightly against the solder eye terminal 12 and the U-shaped bend 13, thus, additionally secures the end 15 against slippage. It is thereby possible to obtain an effective solder connection between the wire end 15 and the solder eye terminal 12.

Referring to FIG. 3, a spacing "a" between a free end face 24 of the solder eye terminal 12 adjacent the U-shaped bend 13 and a face surface 25 of the solder terminal strip 11 is selected of adequate size so that a wire guide tube 21 of an automatic winding machine may pass therethrough. During assembly, the coil 22 is first wound on the coil body 17 by the wire guide 21 of an automatic winding device moving in the direction of arrows "A" and "B", as shown at D. The wire guide 21 is then moved to the position E, Where it undergoes motion in the direction C to wrap wire 26 on the terminal 12 at 27 without being reoriented in a different direction. A swivel motion of the wire guide 21 when wrapping a wire around the winding carrier 17 and then winding the wire end onto the region 13 of the solder eye terminal 12 that is bent U-shaped is, thus, avoided. Appropriate selection of the spacing "a" allows the wire guide tube 21 to move in the direction of the arrow C through free space without interference.

The wire terminals 12 are injected into the terminal strips 11. For example, the wire terminals are mounted in position as the terminal strip 11 and coil member 10 is being molded, such as of plastic. Alternately, a heated wire terminal 12 may be forced into the already molded coil member 10. The wire terminals are arranged in a row on the terminal strip, at one or both ends of the coil member 10.

Thus, by providing the solder terminals in the form of wire pins with a U-shaped end having an end face spaced from the solder terminal strip, it is possible to apply either thick wires to the coil body and have the thick wires make an effective solder contact to the solder terminal, or to wind thin wires on the coil body using an automatic winding machine with the winding machine then wrapping the thin wire about the solder terminal in a simple and effective way.

Although other modifications and changes may be suggested by those skilled in the art, it is the intention of the inventor to embody within the patent warranted hereon all changes and modifications as reasonably and properly come within the scope of his contribution to the art.

I claim:

1. In a coil body on which is wound an electrical coil of wire, the coil body having a coil body flange, the improvement comprising:

a solder terminal strip applied to said coil body flange; and solder eye terminals in the form of right angle wire pins arranged in a row injected into said solder terminal strip, first ends of said solder eye terminals being solder eyes that extend outwardly from said solder terminal strip and are each bent in a U-shaped part that has a free end face thereof directed back towards said solder terminal strip of said coil body flange, said wire of said electrical coil being wrapped on said U-shaped part, second ends of said solder eye terminals being pins mounted for emplacement on printed circuit boards, said free end faces being spaced a predetermined distance from said solder terminal strip wherein said predetermined distance is greater than a thickness of said wire of said electric coil to permit said wire to be automatically wound on said solder eyes.

2. A coil body as claimed in claim 1, wherein said coil body flange is a coil body flange of an EC coil having core halves in an E shape with curved C-shaped surfaces.

3. A coil body as claimed in claim 1, wherein said solder terminal strip is of a molded plastic material and said solder eye terminals are molded into said solder terminal strip.

4. A coil body as claimed in claim 3, wherein said solder terminal strip is injection molded.

5. A coil body as claimed in claim 1, wherein said solder terminal strip is formed of a plurality of members separated by wire lead-out slots, and one of said solder eye terminals is mounted in each of said membranes.

6. A coil body as claimed in claim 1, wherein said predetermined distance is greater than a width of a wire guide tube of an automatic wire winding tool so that said wire guide tube may pass between said free end face of said solder eyes and said solder terminal strip.

* * * * *